US007234969B2

(12) United States Patent
Chang et al.

(10) Patent No.: US 7,234,969 B2
(45) Date of Patent: Jun. 26, 2007

(54) CARD CONNECTOR

(75) Inventors: Wei-Cheng Chang, Tu-Cheng (TW); Hsueh Lung Hsiao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/219,094

(22) Filed: Sep. 2, 2005

(65) Prior Publication Data

US 2006/0223376 A1 Oct. 5, 2006

(30) Foreign Application Priority Data

Apr. 1, 2005 (TW) ..... 94205103 U

(51) Int. Cl.
*H01R 24/00* (2006.01)

(52) U.S. Cl. ..... 439/630; 439/680

(58) Field of Classification Search ..... 439/630, 439/680

See application file for complete search history.

(56) References Cited

U.S. PATENT DOCUMENTS 6,589,061 B1 * 7/2003 Korsunsky et al. ..... 439/83
6,612,492 B1 * 9/2003 Yen ..... 235/451
7,056,155 B2 * 6/2006 Fan ..... 439/630
7,059,910 B1 * 6/2006 Chang ..... 439/630
7,059,912 B2 * 6/2006 Tsai ..... 439/630
2005/0159048 A1 * 7/2005 Hung et al. ..... 439/630
2006/0079131 A1 * 4/2006 Ko ..... 439/630
2006/0223376 A1 * 10/2006 Chang et al. ..... 439/630

* cited by examiner

*Primary Examiner*—James R. Harvey
(74) *Attorney, Agent, or Firm*—Wei Te Chung

(57) ABSTRACT

A card connector includes an insulating housing (1), a number of contacts including a first set of contacts (4) and a second set of contacts (2), and a third set of contacts (3) retained in the insulating housing (1) and a first holding plate (8') and a second holding plate (8). The insulating housing (1) defines a card receiving space (130) with a card inserting opening along a card inserting direction. The first holding plate (8') with the first contacts (4) arranged and a second holding plate (8) with the second contacts (2) arranged are assembled to the housing (1). The soldering portions of the second set of contacts (2) are arranged alternately with the soldering portions of the first set of contacts (4) and the third set of contacts (3) respectively.

18 Claims, 8 Drawing Sheets

CARD CONNECTOR

BACKGROUND OF THE INVENTION

1. Field of the Invention

The present invention relates to a card connector, especially to a card connector which can accept two or more different cards.

2. Description of Related Art

With development of consuming products, such as digital cameras, PDA (Personal Digital Assistance), portable audio and the like, a lot of different kinds of cards, such as an SD (Super Density, Secure Digital) card, an MMC (Multi-Media Card), an MS (Memory Stick) card and an XD (XD-picture) card etc., are widely used in the field of the consuming products. Because of requirements of miniaturization of the consuming products, a card connector which is adapted for receiving a single card is required to accept two or more different cards so as to downsize overall dimension of the consuming products.

A conventional card connector which can accept more different cards defines a single card receiving space and different contacts exposed into the card receiving space for electrically connecting with corresponding cards. Because the different contacts are receiving in one and the same card receiving space, it is bound to encounter a problem of arrangement of different contacts to design the card connector, namely how to avoid short circuit or Electro Magnetic Interference (EMI) of different contacts which abut against one another to assure better signal transmission and easily manufacture. In addition, the different contacts have different soldering portions soldered on a printed circuit board (PCB), when all the different soldering portions are soldered on different districts of the PCB, it is certain to encounter another coplanar problem of different soldering portions, therefore, increasing difficulty of manufacturing, assembling or soldering of the card connector.

Hence, an improved card connector is required to overcome the problems of the prior art.

SUMMARY OF THE INVENTION

An object of the present invention is to provide a card connector which can securely assure signal transmission and easy manufacture.

Accordingly, to achieve above-mentioned object, a card connector comprises an insulating housing, a plurality of contacts including at least a first set of contacts and a second set of contacts, and a third set of contacts retained in the housing and at least a first holding plate and a second holding plate. The insulating housing defines a card receiving space with a card inserting opening along a card inserting direction. The sets of contacts comprise corresponding contacting portions exposed into the card receiving space and corresponding soldering portions exposed outside the housing. The first holding plate with the first contacts arranged thereon and a second holding plate with the second contacts arranged thereon are assembled to the housing. The soldering portions of the second set of contacts are arranged alternately with the soldering portions of the first set of contacts and the third set of contacts respectively.

The detailed features of the present invention will be apparent in the detailed description with appropriate reference to the accompanying drawings.

BRIEF DESCRIPTION OF THE DRAWINGS

FIG. 10 is an assembled, perspective view of the card connector shown in FIG. 1, a shell not assembled on.

DETAILED DESCRIPTION OF THE INVENTION

Figure 1:
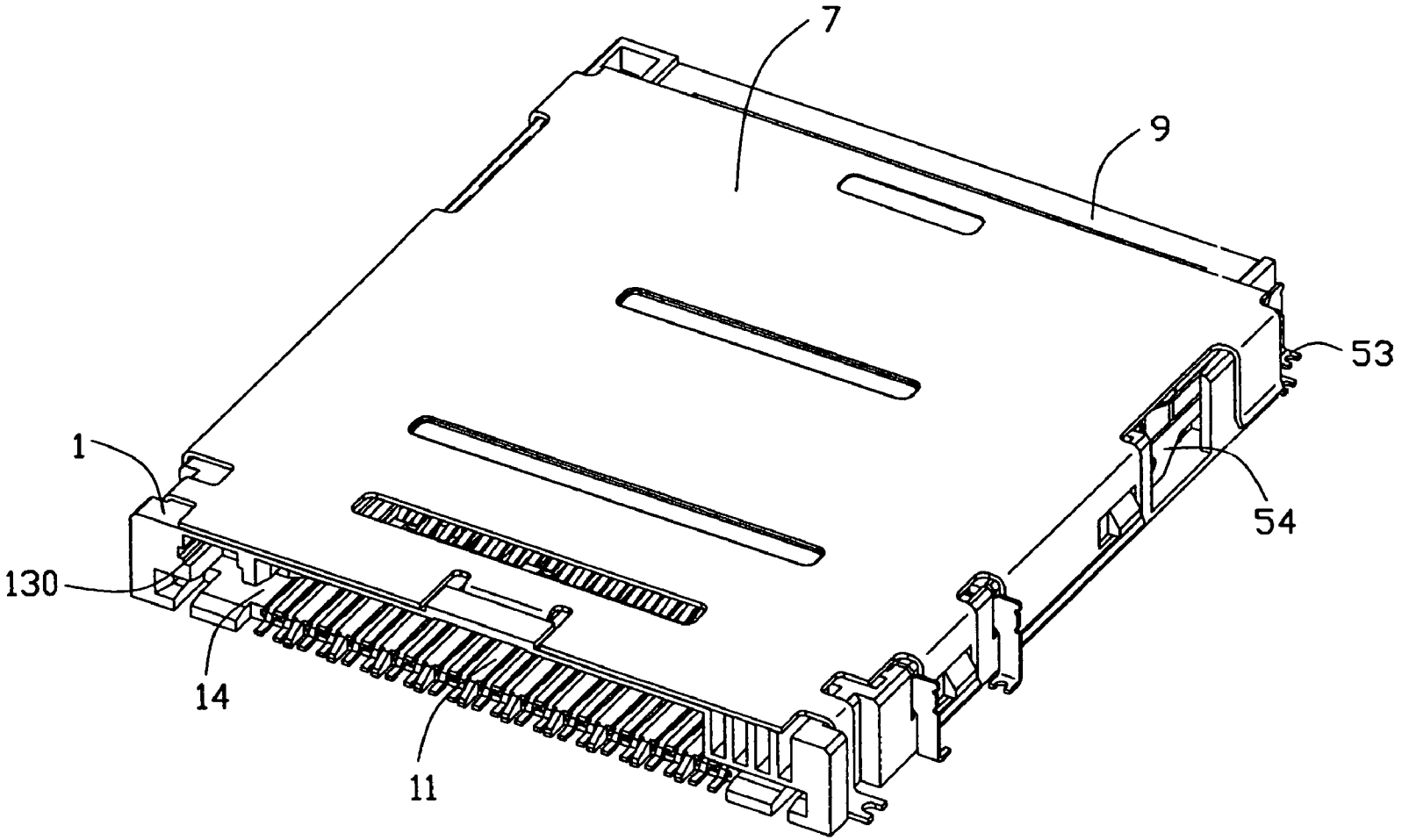
FIG. 1 is an assembled, perspective view of a card connector in accordance with a preferred embodiment of the present invention.

Reference will now be made in detail to the preferred embodiment of the present invention.

Referring to FIGS. 1 to 10, a card connector in accordance with the present invention is adapted for insertion of different kinds of cards. The card connector comprises an insulating housing 1, a plurality of sets of contacts including a first set of contacts 4, a second set of contacts 2, a third set of contacts 3, and a fourth set of contacts 5 for electrically connecting with different cards such as an XD card, an MS card, an SD/MMC card and an SM card respectively, a defend mechanism 6, a conductive shell 7 and a first and second holding plates 8', 8 assembled on the housing 1 and with the first set of contacts 4 and the second set of contacts 2 being arranged therein respectively.

The insulating housing 1 is approximately box-liked and comprises a top wall 16, a pair of opposite sidewalls 12, 13, a bottom wall 14 and a rear wall 15, which commonly define a card receiving space 130. The insulating housing 1 further defines a card inserting opening 11 recessed inwardly from a front face thereof to communicate with the card receiving space 130. The top wall 16 is formed with an opening 100 communicating with the card receiving space 130 and located behind the card inserting opening 11 along a card inserting direction, and the top wall 16 is further formed with a cut 160 adjacent to the card inserting opening 11.

The shell 7 is disposed on the top wall 16 of the housing 1 in virtue of forming with a holding piece 76 at front end thereof to lock in the cut 160 of the housing 1. The defend mechanism 6 is disposed in the housing 1 and partly protrudes into the card receiving space 130 for preventing cards from mismating.

Referring to FIGS. 2, 5, 6 and 7, the first holding plate 8' is approximately plate configuration and formed with a protruding portion 80' (shown in FIG. 6) at rear portion thereof to prevent a card, such as an SD/MMC card, from mismating. The first set of contacts 4 are made of metal leaf spring and arranged in the first holding plate 8'. Each contact 4 comprises a contacting portion 41 exposed in the card receiving space 130 and a soldering portion 42 extending rearward from the contacting portion 41 to be exposed outside the rear wall 15. The soldering portions 42 are divided into two groups to leave a space (not labeled) therebetween and a conductive bar (not labeled) connects the contacting portions 41. In addition, the first set of contacts 4 further comprise a sensor switch 43 disposed at a distal end thereof with a contacting portion 41 differed from these of other contacts 4. A grounding contact 44 and a protecting contact 45 are further included in the first contacts 4 and respectively disposed in the sidewall 12.

Figure 3:
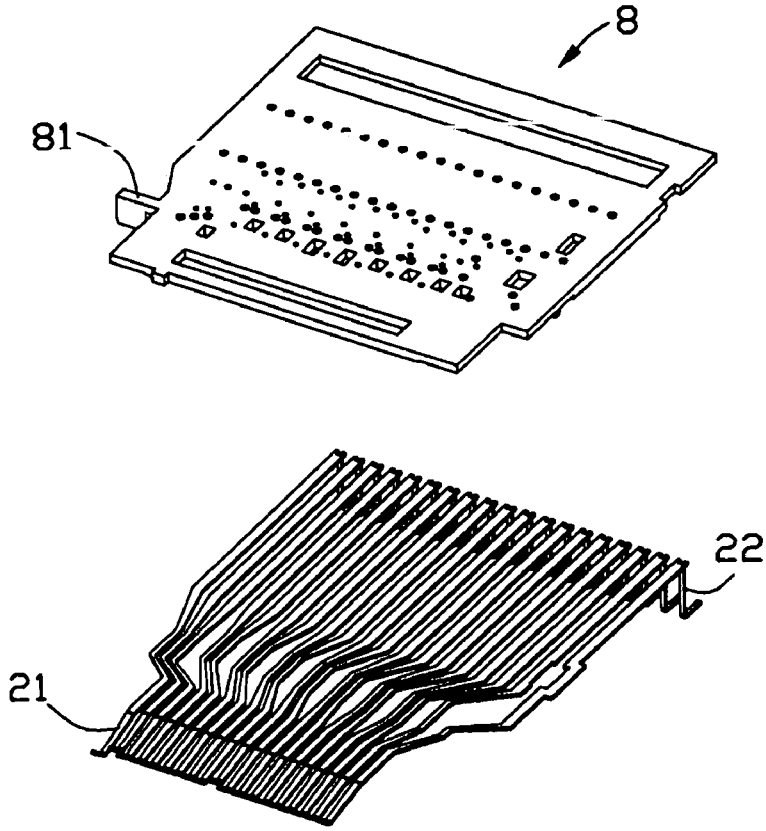
FIG. 3 is a partially exploded, perspective view of FIG. 2, showing a second set of contacts detached from a second holding plate.
Figure 4:
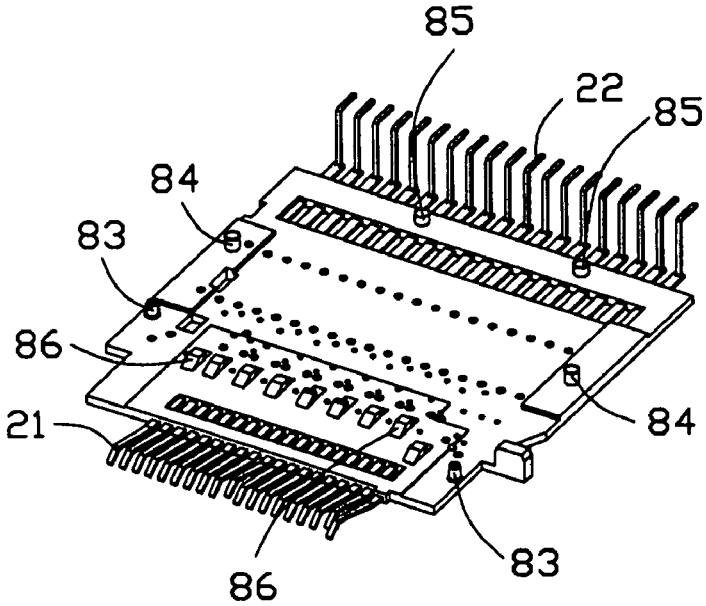
FIG. 4 is an assembled, perspective view of FIG. 3, but from another aspect.
Figure 5:
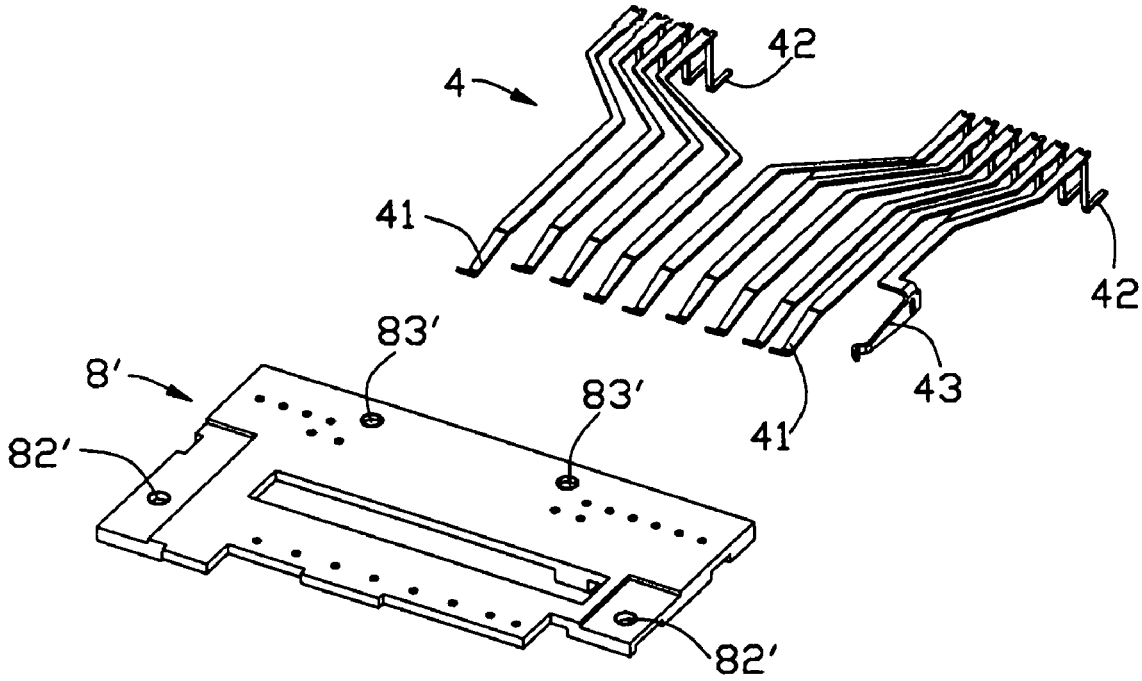
FIG. 5 is a partially exploded, perspective view of FIG. 1, showing a first set of contacts detached from a first holding plate.
Figure 6:
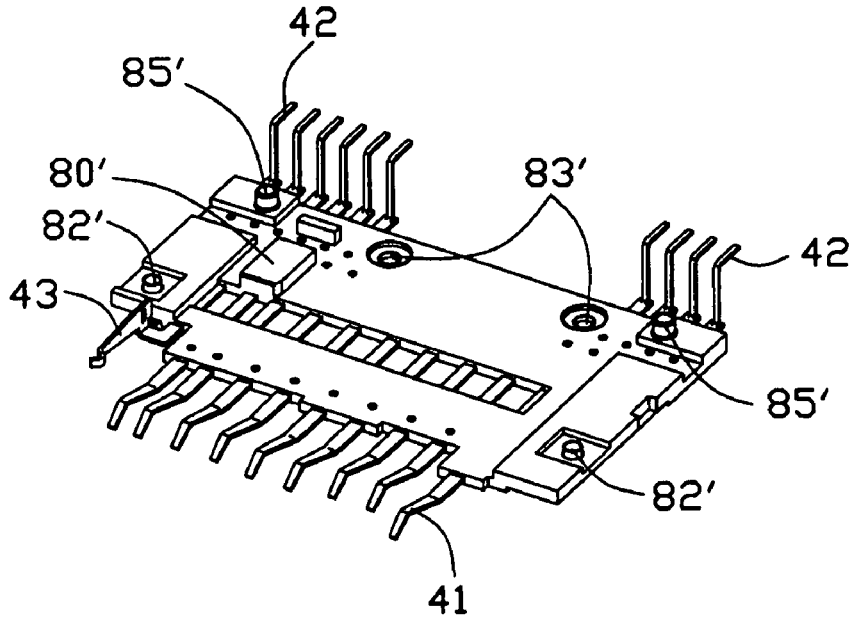
FIG. 6 is an assembled, perspective view of FIG. 5 and viewed from another aspect.
Figure 7:
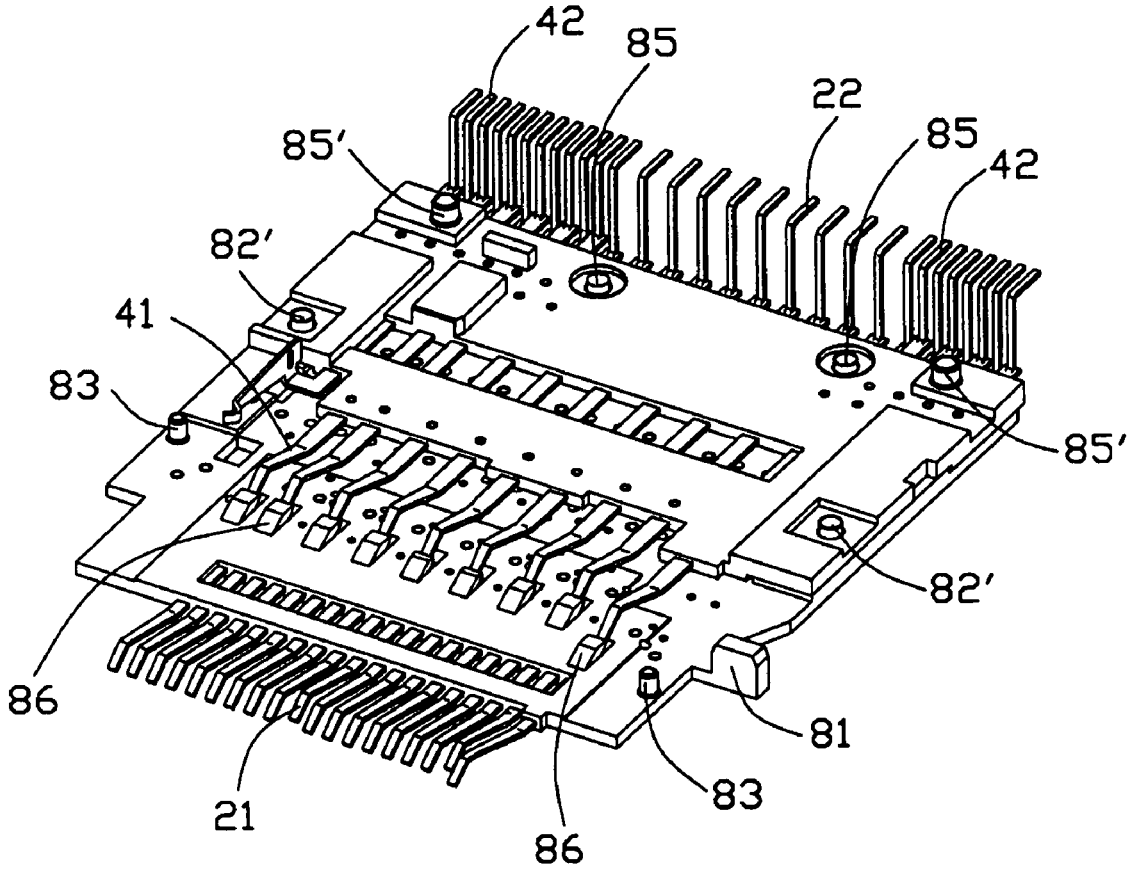
FIG. 7 is an partially assembled, perspective view of the card connector shown in FIG. 2.
Figure 10:
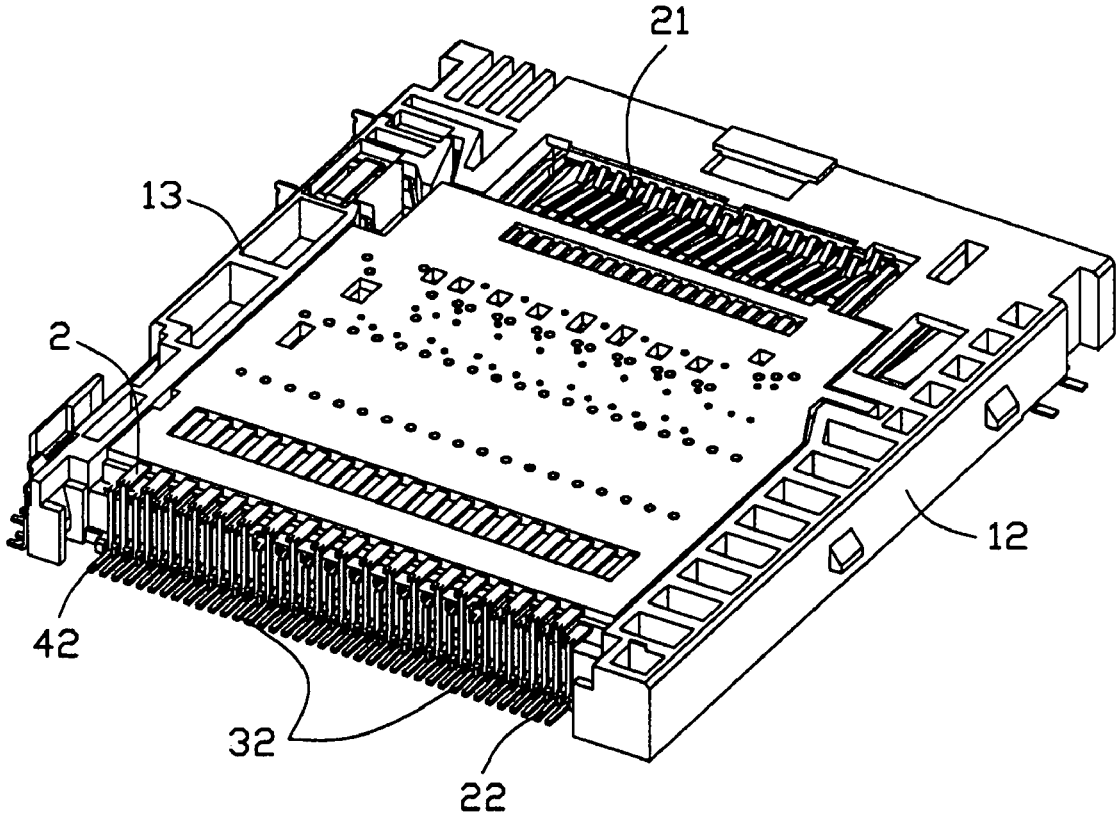

Referring to FIGS. 3, 4 and 10, the second holding plate 8 is also approximately plate configuration. The second set of contacts 2 are arranged in the second holding plate 8 and each comprises a contacting portion 21 exposed in the card receiving space 130 adjacent to the card inserting opening 11 and a soldering portion 22 extending from the contacting portion 21 and located beyond the rear wall 15 of the housing 1. The second holding plate 8 is formed with a plurality of protrusions 86 aligned at front end thereof.

Figure 2:
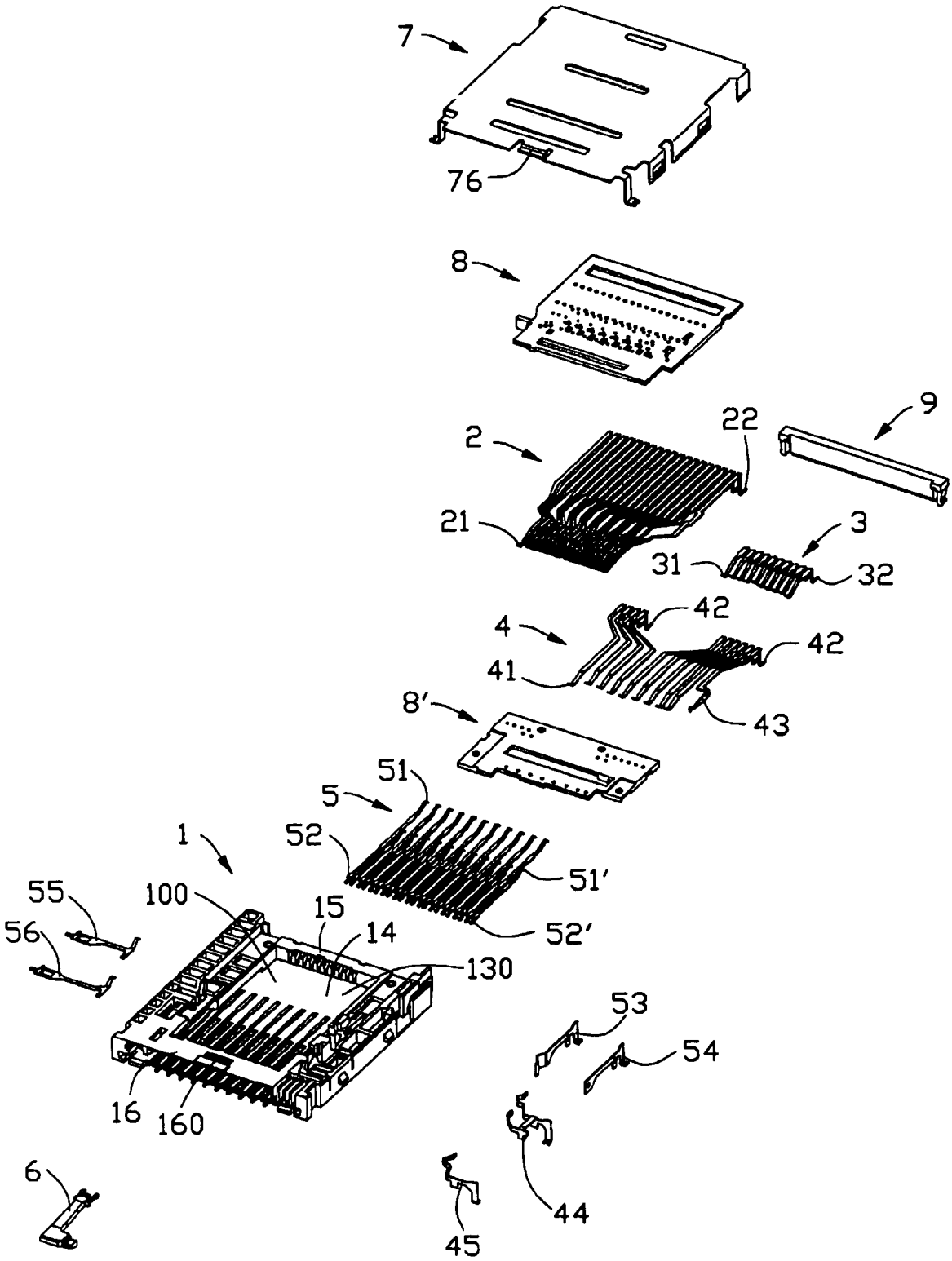
FIG. 2 is an exploded, perspective view of the card connector shown in FIG. 1.
Figure 8:
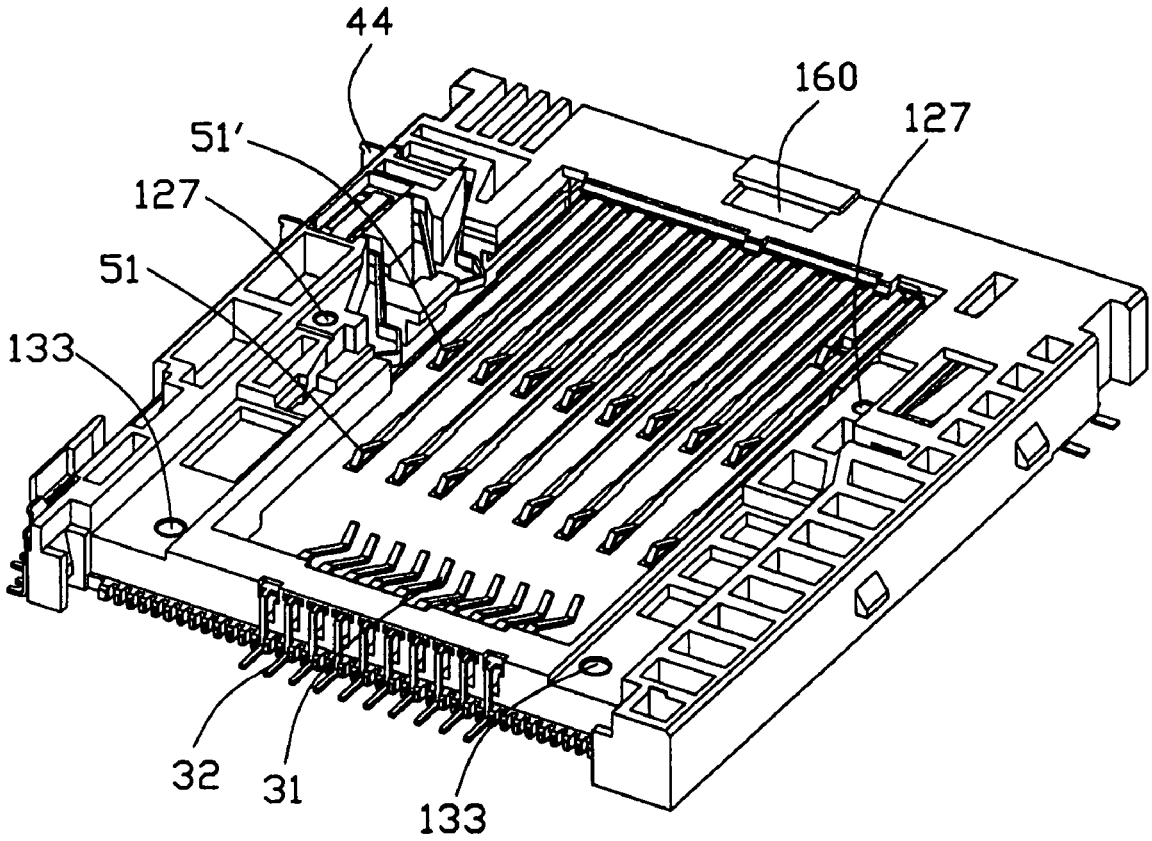
FIG. 8 is a partially assembled, perspective view of the card connector shown in FIG. 2.
Figure 9:
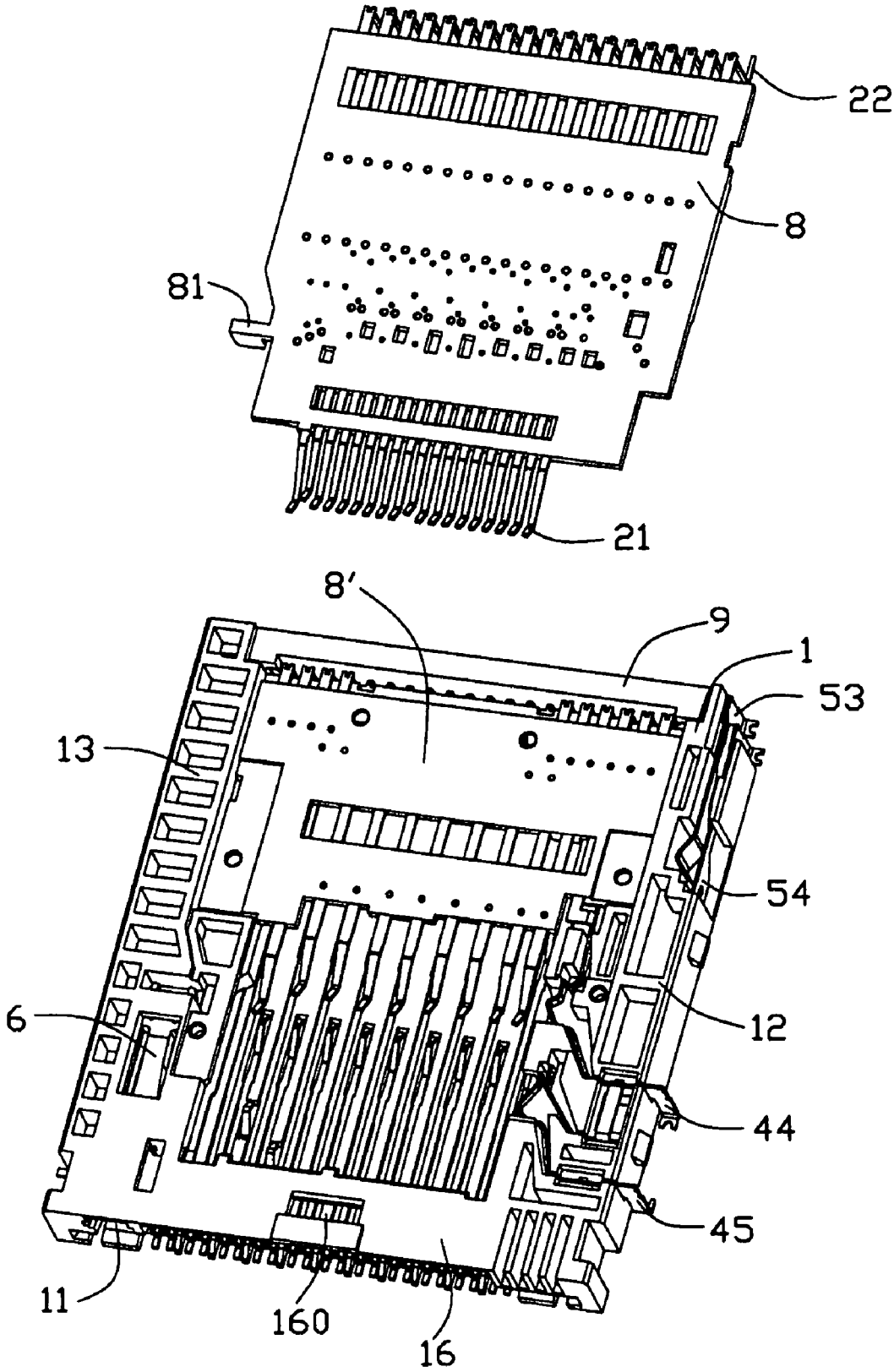
FIG. 9 is a partially exploded, perspective view of the card connector shown in FIG. 2.

Referring to FIGS. 2 and 8, the third set of contacts 3 are disposed in contacting channels (not labeled) formed in the rear wall 15 of the housing 1. Each contact 3 comprises a contacting portion 31 exposed in the card receiving space 130 and a soldering portion 32 extending from the contacting portion 31 to expose outside the rear wall 15. In conjunction with FIGS. 9 and 10, when the first holding plate 8' with the first set of contacts 4 arranged therein is assembled to the housing 1, the soldering portions 32 of the contacts 3 are in alignment with and located in the space between the two groups of the soldering portions 42 of the contacts 4 along a transverse direction perpendicular to a card inserting direction.

Referring to FIGS. 2 and 8, the fourth set of contacts 5 are disposed on the bottom wall 14 and comprise two rows of contacting members with different lengths and arranged alternately. The contacting members comprise contacting portions 51, 51' exposed in the card receiving space 130 and soldering portions 52, 52' extending forwardly from the contacting portions 51, 51' to expose outside the front face of the housing 1. The length of the contacting portions 51 is longer than that of the contacting portion 51'. Longitudinally extending sensor contact 53 and grounding contact 54 are disposed in the sidewall 12 of the housing 1 adjacent to the rear wall 15 and transversely extending read/written contacts 55, 56 are disposed in the sidewall 13 of the housing 1 adjacent to the card inserting opening 11.

Referring to FIGS. 6, 7, 8 and 10, the first holding plate 8' with the first set of contacts 4 arranged therein and the second holding plate 8 with the second set of contacts 2 arranged therein are assembled together by receiving portions 82', 83' formed on the first holding plate 8' mating with columns 84, 85 of the second holding plate 8. The receiving portion 82' is a hollow protrusion. The free ends of contacting portions 41 of the first set of contacts 4 bend upward and are arranged behind the protrusions 86 of the second holding plate 8. Because the first set of contacts 4 are received in the first holding plate 8' and the second set of contacts 2 are received in the second holding plate 8. Therefore, the first set of contacts 4 and the second set of contacts 2 are insulated from each other by the first holding plate 8' and the second holding plate 8, thus, avoiding short circuit or EMI between the second set of contacts 2 and the first set of contacts 4.

The assembly of the first holding plate 8' and the second holding plate 8 are assembled on the housing 1 to cover the opening 100 with columns 85' formed on the first holding plate 8' and cylindrical portions 83 and a block 81 disposed on the second holding plate 8 mating with holes 133, 127 and a recess (not labeled) defined on the sidewalls 12 or 13 of the housing 1 respectively. The different contacting portions 22, 32, 42 of the contacts 2, 3, 4 extend outside the rear wall 15 of the housing 1, and the contacting portions 32 are located between the two groups of the contacting portions 42 and the assembly of the contacting portions 32 and the contacting portions 42 are arranged alternately with the contacting portions 22 of the second set of contacts 2.

Referring to FIGS. 1 and 2, a holding member 9 is assembled to the rear wall 15 of the housing 1 to hold the soldering portions 22, 32 and 42 of the corresponding card contacts 2, 3 and 4.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A card connector, comprising:

an insulating housing defining a card receiving space with a card inserting opening along a card inserting direction;

at least a first set of contacts and a second set of contacts retained in the housing, the sets of contacts comprising corresponding contacting portions exposed into the card receiving space and corresponding soldering portions exposed outside the housing; and at least a first holding plate with the first contacts arranged thereon and a second holding plate with the second contacts arranged thereon assembled to the housing, wherein the first holding plate assembles together with the second holding plate to insulate the first and second sets of contacts, and the soldering portions of the second set of contacts arranged alternately with the soldering portions of the first set of contacts respectively.

2. The card connector as described in claim 1, further including a third set of contacts with corresponding contacting portions and soldering portions thereof, wherein the soldering portions of the first set of contacts are alternately arranged with those of the second set of contacts and those of the third set of contacts, respectively.

3. The card connector as described in claim 2, wherein the soldering portions of the first, second and third sets of contacts are arranged alignedly.

4. The card connector as described in claim 3, wherein the soldering portions of first set of contacts are divided into two groups to leave a space therebetween, and wherein the contacting portions of the third contacts are arranged in the space.

5. The card connector as described in claim 2, wherein the housing comprises a top wall, and wherein the top wall defines an opening communicating with the card receiving space, the first and second holding plates are disposed on the housing to cover the opening.

6. The card connector as described in claim 1, wherein free ends of the contacting portions of the first set of contacts abut against the second holding plate to locate behind the contacting portions of the second contacts.

7. The card connector as described in claim 6, wherein the second holding plate comprises a plurality of protrusions aligned at front end thereof to shield the free ends of the of the contacting portions of the first set of contacts.

8. The card connector as described in claim 2, wherein the first holding plate is formed with a protruding portion at rear end thereof to prevent a card from mismating.

9. The card connector as described in claim 2, further comprising a shell covering the insulating housing.

10. The card connector as described in claim 2, further comprising a holding member assembled to the housing to hold the soldering portions of the corresponding different sets of contacts.

11. The card connector as described in claim 2, further comprising a sensor contact and a grounding contact.

12. A card connector comprising:

an insulative housing defining a card receiving space therein and a rear portion thereof;

a first set of contacts disposed in the housing and including first contacting portions extending into the card receiving space and first soldering portions located around the rear portion, the first soldering portions being essentially aligned, respectively, with the corresponding first contacting portions in a front-to-back direction; and a second set of contacts retained in a first holding plate which is attached to the housing, said first set of contacts including second contacting portions extending into the card receiving space and located in a different position with regard to the first contacting portions in said front-to-back direction, and second soldering potions located around the rear portion and essentially aligned with the first soldering portions in a transverse direction perpendicular to said front-to-back direction; wherein wherein the first holding plate assembles together with the second holding plate to insulate the first and second sets of contacts, the second contacting portions are not respectively aligned with the corresponding second soldering portions along said front-to-back direction but in an offset manner.

13. The card connector as claimed in claim 12, wherein said second soldering portions are alternately arranged with the first soldering portions.

14. The card connector as claimed in claim 12, wherein said second soldering portions are commonly located in first region and said first soldering portions are commonly located in second region beside said region, said first region being aligned with said second region in said transverse direction.

15. A card connector comprising:

an insulative housing defining a card receiving space therein and a rear portion thereof;

a first set of contacts disposed in a first insulative structure and including first contacting portions extending into the card receiving space and first soldering portions located around the rear portion; and a second set of contacts retained in a second insulative structure immoveable relative to said first insulative structure, said first set of contacts including second contacting portions extending into the card receiving space and located in a different position with regard to the first contacting portions in said front-to-back direction, and second soldering portions located around the rear portion and essentially aligned with the first soldering portions in a transverse direction perpendicular to said front-to-back direction;

a third set of contacts retained in a third insulative structure immoveable to both first and second insulative structure, said third set of contacts including third contacting portions extending into the card receiving space and located in another different position from the first contacting portions and the second contacting portions in said front-to-back direction, and third soldering portions located around the rear portion and essentially aligned with both the first soldering portions and the second soldering portions in the transverse direction; wherein the second soldering portions and the third soldering portions are located in different regions spaced from each other in the transverse direction; wherein the first soldering portions are interwoven with both said second soldering portions and said third soldering portions.

16. The card connector as claimed in claim 15, wherein at least one of said first, second and third insulative structures are an integral part of the housing.

17. The card connector as claimed in claim 16, wherein said one of the first, second and third insulative structures is one of said second and third insulative structures.

18. A card connector, comprising:

an insulating housing defining a card receiving space with a card inserting opening along a card inserting direction;

at least a first set of contacts and a second set of contacts retained in the housing, the sets of contacts comprising corresponding contacting portions exposed into the card receiving space and corresponding soldering portions exposed outside the housing; and at least a first holding plate with the first contacts arranged thereon and a second holding plate with the second contacts arranged thereon assembled to the housing, and the soldering portions of the second set of contacts arranged alternately with the soldering portions of the first set of contacts respectively; wherein the housing comprises a top wall, and wherein the top wall defines an opening communicating wit the card receiving space, the first and second holding plates are disposed on the housing to cover the opening.

* * * * *